United States Patent [19]

Whittaker

[11] Patent Number: 4,962,362

[45] Date of Patent: Oct. 9, 1990

[54] MULTI-MAGNETIC FIELD PLURAL CORE TRANSFORMER

[76] Inventor: Richard W. Whittaker, 5 North Way, Hopatcong, N.J. 07843

[21] Appl. No.: 330,438

[22] Filed: Mar. 30, 1989

[51] Int. Cl.[5] ..... H01F 27/30

[52] U.S. Cl. ..... 336/175; 336/182; 336/184; 336/212; 336/223

[58] Field of Search ..... 336/175, 176, 174, 212, 336/180, 182, 184, 223

[56] References Cited

U.S. PATENT DOCUMENTS

| | | | |
|---|---|---|---|
| 1,493,656 | 5/1924 | Von Henke | 336/182 |
| 1,504,611 | 8/1924 | Dorfman | 336/184 X |
| 2,251,373 | 8/1941 | Olsson | 336/175 X |
| 2,388,473 | 11/1945 | Dunton | 336/182 X |
| 2,412,345 | 12/1946 | Lindenblad | 336/184 X |
| 2,600,057 | 6/1952 | Kerns | 336/184 X |
| 2,655,623 | 10/1953 | Parker | 336/182 X |
| 3,155,932 | 11/1964 | Oberli | 336/184 X |
| 3,268,843 | 8/1966 | Popp | 336/175 X |
| 3,368,137 | 2/1968 | Kennard et al. | 336/175 X |

FOREIGN PATENT DOCUMENTS

| | | | |
|---|---|---|---|
| 922894 | 1/1955 | Fed. Rep. of Germany | 336/184 |
| 55-61012 | 5/1980 | Japan | 336/184 |

*Primary Examiner*—Thomas J. Kozma

*Attorney, Agent, or Firm*—Lerner, David, Littenberg, Krumholz & Mentlik

[57] ABSTRACT

A multi-magnetic field plural core transformer having two or more non-contacting core loops of ferromagnetic material, each core loop including first and second portions, the first portion of each core loop being positioned adjacent to the first portions of the other core loops with each core loop first portion encircled by a primary winding, and the transformer having means for electrically interconnecting the primary windings in circuit with one another, and at least one secondary winding passing through all core loops.

15 Claims, 4 Drawing Sheets

MULTI-MAGNETIC FIELD PLURAL CORE TRANSFORMER

BACKGROUND OF THE INVENTION

The present invention relates to plural core transformers and, more particularly, to plural core transformers having divided primary windings therein.

In the design of medium and high power output, system transformers, such as low voltage system transformers in the range of from about 15 KVA and up, it is conventional to provide one or more laminated annular cores of ferromagnetic metallic material having openings therein and having one or more primary windings and one or more secondary windings positioned about more than one of the leg portions on one or more cores. The sizes of the openings in the annular metallic cores are, at least in a significant part, determined by the number of turns, by the cross-sectional areas of the conductors employed, and by the core legs occupied by the primary and secondary windings of the transformer.

Accordingly, the more turns that are required by the design, and the greater the cross-sectional area of the conductors that are required therein, the larger must be the openings in the annular metallic cores to accommodate the windings, and, therefore, the larger must be the overall size of the transformer. The ability of the transformer to dissipate heat generated therein decreases as the size of the transformer increases, as a result of the lower surface to volume ratio, yet at the same time the amount of heat generated increases.

The foregoing factors present significant problems in the design of low voltage system transformers of the types used in welding, brazing and bonding, and used in resistance heating and induction furnace systems. The reason for this is that such low voltage system transformers employ secondary windings of few turns in which the conductors thereof have large cross-sectional areas that require correspondingly large openings in the core metal to accommodate them. Thus, providing for efficient heat dissipation and compact size in low voltage system transformers represent an important design criteria for such transformers.

It is, therefore, an object of the present invention to provide low voltage system transformers having enhanced heat dissipation ability.

A further object of the present invention is to provide plural core, multi-magnetic field transformers that are more compact.

Yet another object of the present invention is to provide plural core multi-magnetic field transformers that are more economical to construct and operate than has heretofore been the case.

Further objects and advantages of this invention will become apparent as the following description proceeds.

SUMMARY OF THE INVENTION

One aspect of this invention provides a multi-magnetic field low voltage system transformer having first and second non-contacting core loops of ferromagnetic material, each of which includes first and second portions therein. The first portion of the first core loop is positioned adjacent to the first portion of the second core loop, and first and second primary windings encircle the respective first portions of the first and second core loops. Means are provided for connecting the first and second primary windings in circuit with one another, and a first secondary winding is provided passing through both the first and second core loops.

In accordance with another aspect of the invention, a multi-magnetic field low voltage system transformer having first and second core loops of ferromagnetic material positioned generally coplanar to but out of contact with one another is provided. In accordance with yet another aspect of the invention, there is provided a multi-magnetic field low voltage system transformer having first and second generally rectangular core loops of ferromagnetic material positioned generally coplanar to but out of contact with one another with each core loop including first and second leg members that are generally parallel to one another and to the leg members of the other core loops, the first leg member of the first core loop being positioned adjacent to the first leg member of the second core loop, and the second leg member of the first core loop being positioned remote from the second leg member of the second core loop. Means are provided for connecting the primary windings in circuit with each other. Another aspect of the invention provides a multi-magnetic field transformer in which the primary windings are connected in circuit, either parallel or series.

The multi-magnetic field transformers of the present invention provide greater operating efficiency than the known transformer systems in which multiple primary windings are connected in circuit and wound on separate legs of a single magnetic core, or in which a larger single primary winding having at least twice the size of the primary windings of the present invention is wound on the adjacent legs of two magnetic cores. The present invention with separate primary windings provide independent flux paths capable of meeting total flux requirements.

Furthermore, it is believed that the cooling efficiency obtained by the transformers of the present invention is achieved in part from the increase in surface to volume ratio obtained from size reduction and in part from greater core exposure obtained from locating smaller individual primary windings on separate cores.

BRIEF DESCRIPTION OF THE DRAWINGS

While the specification concludes with claims particularly pointing out and distinctly claiming the subject matter of this invention, it is believed that the present invention will be more readily understood from the following description, taken in conjunction with the accompanying drawings, in which:

DETAILED DESCRIPTION OF THE PREFERRED EMBODIMENT

Figure 1:
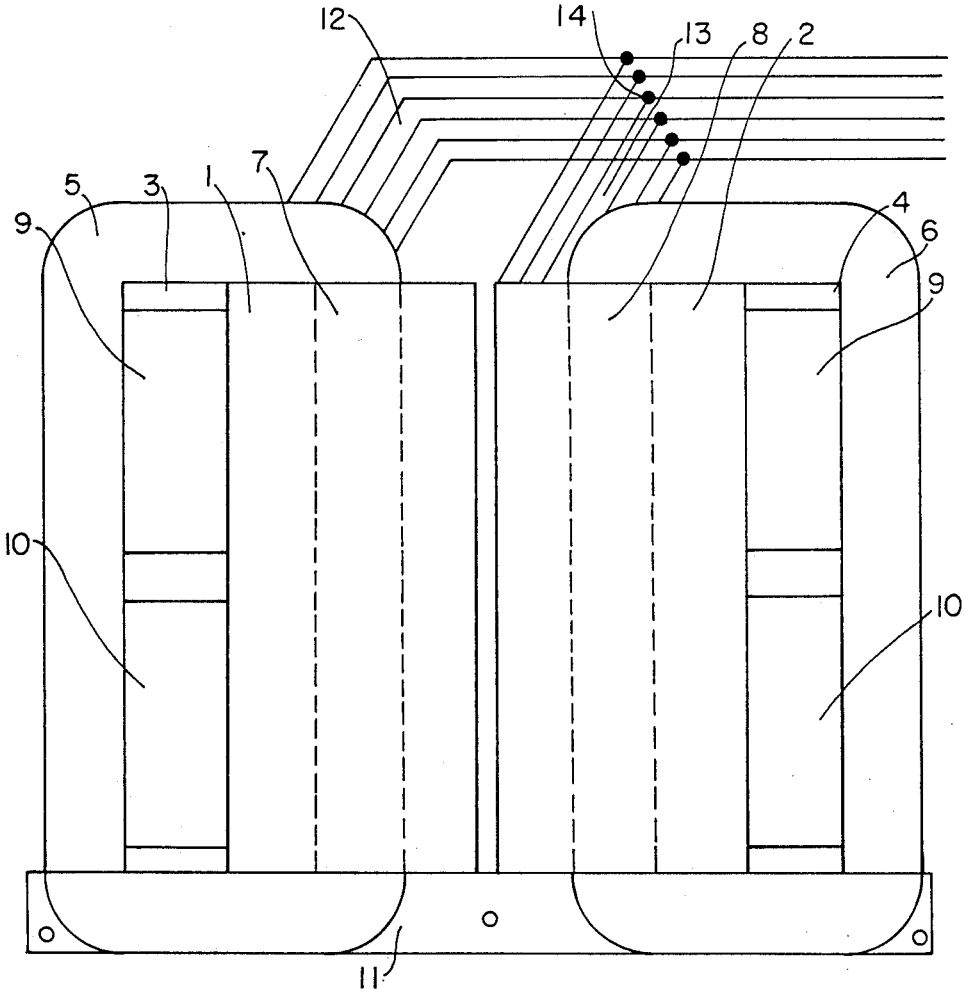
FIG. 1 is an elevational view of a transformer assembly in accordance with one embodiment of the invention.

Throughout the following description, similar reference characters refer to similar members in all figures of the drawings.

Referring now to the drawings, and FIG. 1 in particular, a single phase multi-magnetic field 22 KVA welding transformer has first and second primary windings 1 and 2 wound through the openings 3 and 4 of first and second ferromagnetic core loops 5 and 6 around the first leg portions of each, 7 and 8, respectively, forming a common center around which secondary windings 9 and 10 are wound. The secondary windings are positioned to pass through the openings of both the ferromagnetic core loops. The entire structure is attached to base plate 11 for mounting purposes. Although any ferromagnetic material capable of being formed into a desired shape and having electromagnetic induction properties may be used, the core loops illustrated are wound of Hypersil brand grain oriented high silicon steel strips.

Multiple tap primary winding leads 12 and 13 provide the means by which the primary windings are connected in circuit and are connected in parallel at 14. The primary windings may also be connected in series, although in multiple tap primary windings, parallel connections will almost always be used. The means for connecting primary windings in circuit may also include means for connecting the primary windings to external circuit elements such as busbars, switches, etc. which complete the circuit.

Figure 2:
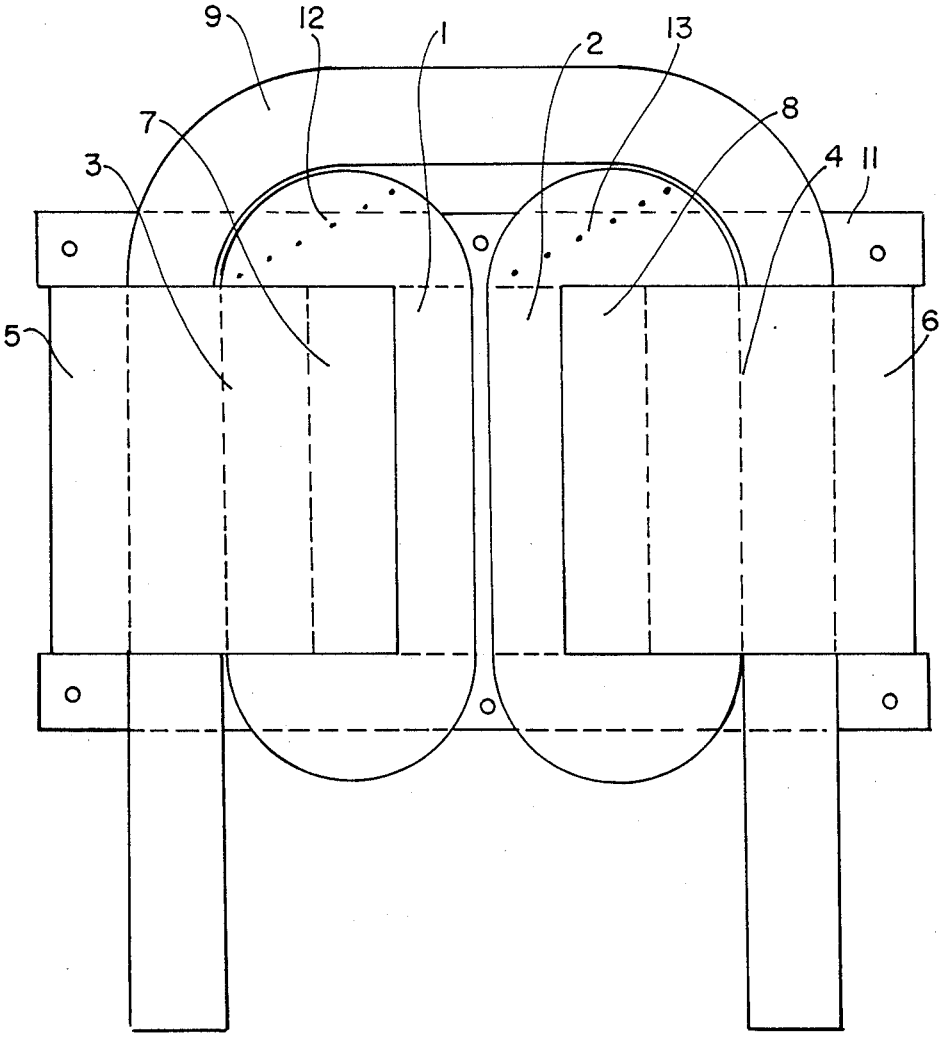
FIG. 2 is a top view of the assembly shown in FIG. 1.
Figure 3:
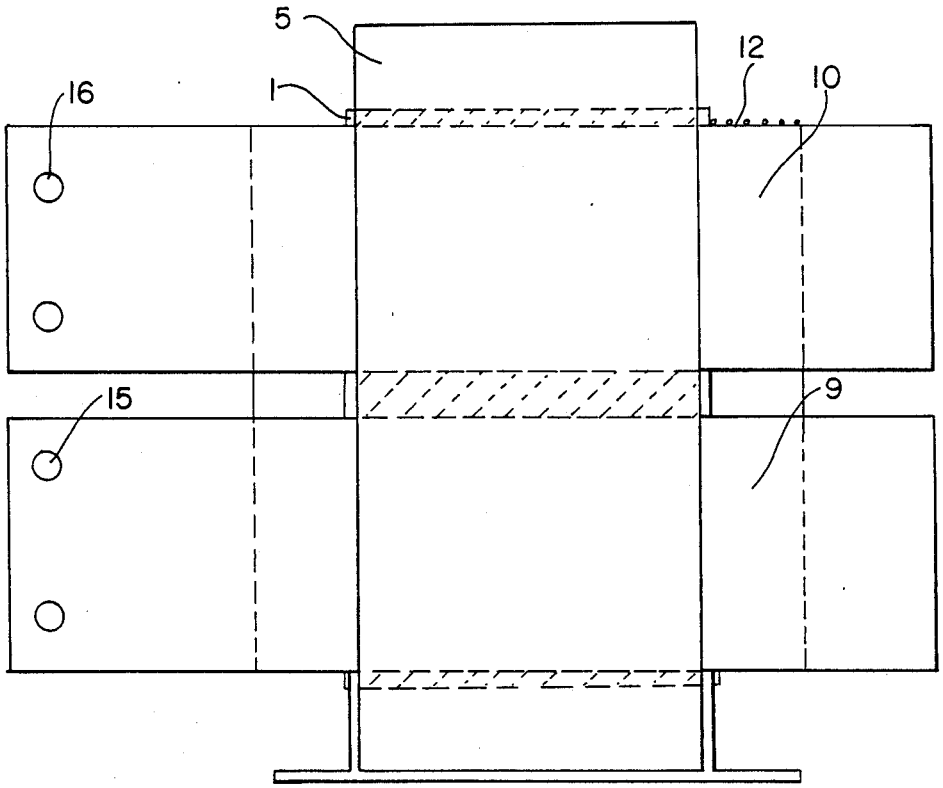
FIG. 3 is a side view of the assembly shown in FIG. 1.

The placement of the two secondary windings to pass through both ferromagnetic core loop openings, winding around both primary windings and the first leg portions of each core loop is shown in FIG. 2, which is a top view of the transformer of FIG. 1, and FIG. 3, which is a side view of same. As shown in FIG. 3, means for connecting the secondary windings in circuit may be attached at connections 15 and 16. The means for connecting secondary windings in circuit may also include means for connecting the secondary windings to external circuit elements such as busbars, switches, etc., which complete the circuit. The secondary windings of the depicted transformer can be hooked up in series or parallel in order to obtain desired voltage. When two secondary windings are connected in circuit twice the voltage at one-half the current is induced into secondary windings connected in series, while twice the current at one-half the voltage is induced into secondary windings connected in parallel.

The present invention is particularly suitable to high current transformers, especially low voltage high current transformers, in which significant quantities of heat are generated. Low voltage systems are defined as electrical systems that operate at a potential of less than 1000 volts using standard insulating methods. The heat dissipation efficiency achieved by preferred embodiments of the present invention is particularly significant in these applications.

Depending upon the application and type of transformer, the primary or the secondary windings of the transformers of the invention typically will be capable of carrying currents of about 1 amp up to about 75,000 amps. More typically, the windings will carry currents of about 5 amps up to about 50,000 amps.

In the multi-magnetic field transformer of the present invention, each primary winding includes a predetermined number of turns of the conductor having a predetermined cross-sectional area. The secondary windings may have the same number of turns of a conductor having a greater or smaller cross-sectional area than the conductor of the primary windings. Alternatively, the secondary windings may have more or fewer turns of a conductor having the same cross-sectional area as the conductor of the primary windings. The secondary windings may have the same or more turns of a conductor having a smaller cross-sectional area than the conductor of the primary windings, and may have more turns than the sum total of all turns of all primary windings, or the secondary windings may have the same or fewer turns of a conductor having a larger cross-sectional area than the conductor of the primary windings. In the high current step-down transformer depicted in FIGS. 1-3, the secondary windings include fewer turns of a conductor having a greater cross-sectional area than the conductor of the primary windings. All of the primary windings should be wound so that the voltages induced in the secondary add rather than cancel. The primary windings of the transformer depicted in FIGS. 1-3 use 202 total turns of copper conductor wire having a predetermined cross-sectional area of 0.016562 square inches. Each secondary winding includes fewer turns of a conductor having a greater cross-sectional area. The secondary windings depicted use a single turn of copper conductor wire having a predetermined cross-sectional area of 1.4 square inches. Multiple primary or secondary windings need not have identical numbers of turns or cross-sectional areas.

For primary windings connected in parallel the volts per turn induced in each secondary winding is the sum of the volts per turn induced by each primary winding. The number of turns needed of secondary winding to achieve a desired voltage is therefore reduced proportionally with the number of primary windings, allowing either a reduction in size of the core loop or an increase in the cross-sectional area of the secondary winding conductors. Preferably, the primary and secondary windings substantially fill the openings defined by the core loop. The depicted transformer will work at room temperature and is 50% smaller than conventional 22KVA welding transformers capable of operating at room temperature.

The secondary winding may be a single winding or may include multiple secondary windings connected in circuit, either series or parallel. The secondary winding may define a straight line passing through the core loops, or it may be bent and/or form a bight in which the first portions of the core loops are located, or it may encircle either or both of the first portions of the core loops and the primary windings. Secondary windings that encircle the first portions of the core loops or the primary windings may include one or more turns. It is not essential that the primary windings be located between the secondary winding and the core portion around which the primary is wound, the only requirement is that the secondary windings pass through each ferromagnetic core loop opening. In such a situation, each core loop will have a primary winding wound around part of the first leg portion of the core loop and the secondary winding or windings will occupy the part of each core loop not occupied by a primary winding, passing through each core loop.

Figure 4:
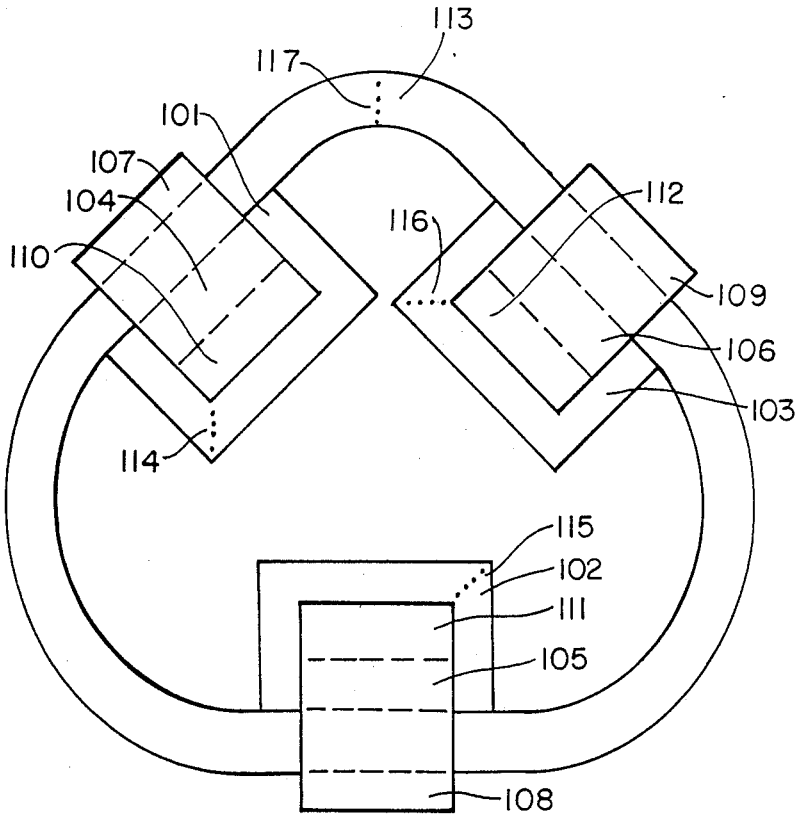
FIG. 4 is an top view of a transformer assembly according to another embodiment of the invention.

More than two core loops may also be used, as shown in FIG. 4, arranged similarly to the two core loop transformer shown in FIGS. 1-3.

Primary windings 101, 102 and 103 are wound through the openings 104, 105 and 106 of ferromagnetic core loops 107, 108 and 109 around the first leg portions of each, 110, 111 and 112, respectively, forming a common center around which secondary winding 113 is wound, which secondary winding also passes through the openings of all core loops. Means 114, 115 and 116 for connecting the primary windings in circuit are provided as in FIGS. 1-3 and the primary windings are preferably connected in parallel circuit. Means 117 for tapping the secondary winding is also provided.

Since numerous changes may be made in the above-described apparatus and different embodiments of the invention may be made without departing from the spirit thereof, it is intended that all of the matter contained in the foregoing description, or shown in the accompanying drawings, shall be interpreted as illustrative, rather than limiting.

I claim:

1. A multi-magnetic field low voltage system transformer having first and second non-contacting single-loop generally rectangular core loops of ferromagnetic material, each of said core loops including first and second leg members that are generally parallel to one another and to the leg members of the other of said core loops, said first leg member of said first core loop being positioned adjacent to said first leg member of said second core loop, said second leg member of said first core loop being positioned remote from said second leg member of said second core loop, a first primary winding encircling only said first leg member of said first core loop, with the remainder of said first core loop being substantially free of primary windings, a second primary winding encircling only said first leg member of said second core loop, with the remainder of said second core loop being substantially free of primary windings, means for electrically interconnecting said primary windings in parallel circuit with one another, and a first secondary winding passing through said first and second core loops and froming a bight within which said first and second primary windings on said first leg members of said core loops are located.

2. A transformer according to claim 1, wherein said first secondary winding encircles said first and second primary windings on said first portions of said first and second core loops.

3. A transformer according to claim 1, further comprising a second secondary winding passing through said first and second core loops and forming a bight within which first and second primary windings are located and means for electrically interconnecting said first and second secondary windings in circuit with one another.

4. A transformer according to claim 1, wherein said means for electrically interconnecting said primary windings in circuit includes means for connecting said primary windings to external circuit elements.

5. A transformer according to claim 3, wherein said means for electrically interconnecting said secondary windings in circuit includes means for connecting said secondary windings to external circuit elements.

6. A transformer according to claim 1, further comprising at least one additional non-contacting single-loop generally rectangular core loop of ferromagnetic material including first and second leg members that are generally parallel to one another and to the leg members of the other of said core loops, said first leg member of each said additional core loop being positioned adjacent to said first leg members of said first and second core loops, and at least one additional primary winding, each said additional primary winding encircling only the first portion of one of said additional core loops, with the remainder of said additional core loops being substantially free of primary windings, the transformer further comprising means for electrically connecting said additional primary windings in parallel circuits with said first and second primary windings, and said first secondary winding passing through all of said core loops, and forming a bight within which all of said primary windings are located.

7. A transformer according to claim 6, wherein said first secondary winding encircles all of said primary windings on said first portions of all of said core loops.

8. A transformer according to claim 1, wherein said primary and secondary windings substantially fill said core loops.

9. A transformer according to claim 1, wherein each of said primary windings includes a predetermined number of turns therein, and said first secondary winding includes the same number of turns.

10. A transformer according to claim 1, wherein each of said primary windings includes a conductor having a predetermined cross-sectional area, and said first secondary winding includes a conductor having the same cross-sectional area.

11. A transformer according to claim 1, wherein each of said primary windings includes a predetermined number of turns therein of a conductor having a predetermined cross-sectional area, and wherein said first secondary winding comprises a conductor having a smaller cross-sectional area than either of the conductors in said primary windings, said first secondary winding including more turns of the conductor therein than the number of turns of the conductor included in said primary windings.

12. A transformer according to claim 1, wherein each of said primary windings includes a predetermined number of turns therein of a conductor having a predetermined cross-sectional area, and wherein said first secondary winding comprises a conductor having a greater cross-sectional area than either of the conductors in said primary windings, said first secondary winding including fewer turns of the conductor therein than the number of turns of the conductor included in either of said primary windings.

13. A transformer according to claim 3, wherein said first and second secondary windings are connected in parallel.

14. A transformer according to claim 3, wherein said first and second secondary windings are connected in series.

15. A transformer according to claim 1 wherein said first and second core loops of ferromagnetic material are positioned generally coplanar to one another.

* * * * *

UNITED STATES PATENT AND TRADEMARK OFFICE

CERTIFICATE OF CORRECTION

PATENT NO. : 4,962,362

DATED : October 9, 1990

INVENTOR(S) : Whittaker et al.

It is certified that error appears in the above-identified patent and that said Letters Patent is hereby corrected as shown below:

Column 3, line 46, "1000" should read --10,000--.

Column 5, line 39, after "which" insert --said--.

Signed and Sealed this

Twenty-first Day of July, 1992

*Attest:*

DOUGLAS B. COMER

*Attesting Officer*

*Acting Commissioner of Patents and Trademarks*